US008002425B2

(12) United States Patent
Russo et al.

(10) Patent No.: US 8,002,425 B2
(45) Date of Patent: Aug. 23, 2011

(54) LIGHTING ASSEMBLY AND LAMP AIMING DEVICE

(75) Inventors: Neil Russo, Jackson, NJ (US); Shailesh I. Naik, Dayton, NJ (US); Steven M. Silverstein, Woodcliff Lake, NJ (US)

(73) Assignee: Hubbell Incorporated, Shelton, CT (US)

( * ) Notice: Subject to any disclaimer, the term of this patent is extended or adjusted under 35 U.S.C. 154(b) by 271 days.

(21) Appl. No.: 12/347,253

(22) Filed: Dec. 31, 2008

(65) Prior Publication Data

US 2010/0165646 A1 Jul. 1, 2010

(51) Int. Cl.
*F21V 21/30* (2006.01)

(52) U.S. Cl. ..... 362/148; 362/150; 362/269; 362/287; 362/271

(58) Field of Classification Search ..... 362/148, 362/150, 147, 269, 271, 287, 272, 273, 274
See application file for complete search history.

(56) References Cited

U.S. PATENT DOCUMENTS

| | | | | |
|---|---|---|---|---|
| 2,518,936 | A | 8/1950 | Roberts | |
| 2,898,075 | A | 8/1959 | McGinty | |
| 2,984,738 | A | 5/1961 | Belau | |
| 4,173,037 | A | 10/1979 | Henderson, Jr. et al. | |
| 4,881,157 | A | 11/1989 | Pahl | |
| 5,562,343 | A * | 10/1996 | Chan et al. | 362/365 |
| 5,800,050 | A | 9/1998 | Leadford | |
| 5,823,664 | A * | 10/1998 | Demshki et al. | 362/366 |
| 5,951,151 | A | 9/1999 | Doubeck et al. | |
| 6,082,878 | A | 7/2000 | Doubek et al. | |
| 6,431,723 | B1 | 8/2002 | Schubert et al. | |
| 6,652,124 | B2 | 11/2003 | Schubert et al. | |
| 7,118,254 | B2 | 10/2006 | Czech | |
| 7,186,008 | B2 * | 3/2007 | Patti | 362/365 |
| 7,234,674 | B2 | 6/2007 | Rippel et al. | |
| 7,374,308 | B2 | 5/2008 | Sevack et al. | |
| 2003/0007354 | A1 * | 1/2003 | Schubert et al. | 362/285 |
| 2006/0193142 | A1 * | 8/2006 | Dupre | 362/418 |
| 2006/0261235 | A1 | 11/2006 | Rippel et al. | |
| 2007/0019418 | A1 | 1/2007 | Czech et al. | |
| 2007/0075206 | A1 | 4/2007 | Wright et al. | |
| 2008/0025031 | A1 | 1/2008 | Wronski et al. | |
| 2008/0062693 | A1 | 3/2008 | Czech et al. | |
| 2008/0062705 | A1 | 3/2008 | Czech et al. | |
| 2008/0186717 | A1 | 8/2008 | Ruberg | |
| 2008/0186718 | A1 | 8/2008 | Magisano et al. | |

FOREIGN PATENT DOCUMENTS

| | | |
|---|---|---|
| GB | 2061703 | 5/1981 |

* cited by examiner

*Primary Examiner* — Laura Tso
(74) *Attorney, Agent, or Firm* — Garrett V. Davis; Mark S. Bicks; Alfred N. Goodman

(57) ABSTRACT

A luminaire and lighting assembly is provided having a ceiling pan and a light assembly supported on the ceiling pan. The light assembly is rotatable and movable in a lateral direction on the ceiling pan to provide adjustment of the light assembly with respect to the ceiling pan. The light assembly includes an aiming device which allows the lamp to be adjusted about a vertical axis and about a horizontal axis for adjustment of the lamp. The aiming assembly includes a locking assembly which fixes the position of the aiming assembly to simultaneously prevent rotation about the vertical axis and about the horizontal axis.

32 Claims, 8 Drawing Sheets

LIGHTING ASSEMBLY AND LAMP AIMING DEVICE

CROSS-REFERENCE TO RELATED APPLICATIONS

This application relates to U.S. application Ser. No. 12/347,296 to Russo et al., filed Dec. 31, 2008 entitled "Lighting Assembly with Aperture Alignment Assembly", and U.S. application Ser. No. 12/347,324 to Russo et al., filed Dec. 31, 2008 entitled "Lamp Alignment Assembly and Lighting Device", which are hereby incorporated by reference in their entirety.

FIELD OF THE INVENTION

The present invention is directed to a light fixture having an adjustment mechanism for adjusting the position of the light fixture and for adjusting the direction of the light to a target area. More particularly, the invention is directed to an adjustable light assembly with an adjustable assembly such that the lamp can be adjusted in a selected angular and rotational orientation.

BACKGROUND OF THE INVENTION

Recess lighting fixtures are commonly used in construction. The recess lighting fixtures generally include a base or plaster frame, a lamp holder for holding the electrical lamp and a trim ring. Recessed lighting fixtures provide lighting characteristics that are often desired in new construction and in existing ceilings.

Recessed lighting fixtures are fixed to the ceiling in a specific location and the location of the lighting fixture is often limited by the ceiling structure. Many recessed lighting fixtures have fixed lamps that do not permit adjustment. Depending on the location of the recessed lighting fixture, it may be desirable to aim the lamp in a particular direction to provide the desired lighting pattern or to focus the light in a specific target area. The adjustment mechanisms of many of the prior recessed lighting fixtures are difficult to operate and provide limited orientation of the lamp. The confined area of the recessed lighting fixture also make it difficult to adjust the position of the lamp after the fixture is installed in the ceiling.

Various devices have been proposed for recessed lighting fixtures and downlights having an adjustment mechanism to enable the adjustment and orientation of the lamp. One example is disclosed in U.S. Published Patent Application No. 2006/0193142 to Dupre. The adjustment device in this published application includes a worm gear drive for aiming a locking mechanism for a luminaire. The luminaire assembly includes a collar and a yoke where the yoke is pivotally connected to the collar. A worm gear is attached to the collar and engages gear teeth on an arm to pivot the yoke with respect to the collar. The collar has an inner collar which rotates axially with respect to the outer collar about a vertical axis. In this manner, the luminaire can pivot about a vertical axis and about a horizontal axis.

U.S. Patent Publication 2008/0186717 to Ruberg relates to a compact luminaire having a lamp module bracket assembly. The assembly has a first band and a second band connected together by a pair of arms. The arms are pivotally connected to the band to allow aiming of the luminaire. A screw is tightened to fix the position of the lamp of the luminaire.

U.S. Pat. No. 5,951,151 to Doubeck et al. discloses a lamp assembly for recessed ceiling fixture having a support assembly for a lamp socket and a lamp. The support assembly has a rotation ring to allow rotation about a vertical axis with respect to the frame. The support assembly also includes arms that are pivotally connected to the rotation ring to allow angular adjustment of the lamp about a horizontal axis.

U.S. Pat. No. 6,082,878 to Doubeck et al. discloses a rotatable recessed light fixture with a movable stop member. A spin disk has an upwardly extending tab which engages a stop member upon rotation of the spin disk. The lamp mechanism is able to rotate with the spin disk about a vertical axis. A lamp support also includes a support member for the lamp where the support member is pivotally connected to the lamp mechanism. The support member has a pair of legs with projections which slide within an arcuate slot formed in a bracket that is fixed to the ring. The legs enable the lamp mechanism to pivot about a horizontal axis and a vertical axis with respect to the frame.

U.S. Pat. No. 6,652,124 to Schubert et al. relates to an adjustable light fixture having a rotation adjustment assembly and an angle adjustment assembly for directing a lamp to a target area. The light fixture includes a frame having an aperture and a mounting disk. The mounting disk includes arms which form an angle adjustment assembly for the lamp. A rotation assembly is pivotally connected to the arms and the angle adjustment assembly. The rotation assembly includes a rotation disk and a rotation frame which holds the lamp. The position of the lamp can be adjusted about a horizontal axis and a vertical axis by rotating the rotation assembly with respect to the arms and the mounting disk.

Other adjustable lamp assemblies are disclosed in U.S. Patent Publication No. 2008/0186718 to Magisano et al., U.S. Pat. No. 4,173,073 to Henderson, Jr. et al., U.S. Pat. No. 4,881,157 to Pahl and GB 2,061,703 to Gilbert.

Although the prior devices function in the intended manner, these devices are relatively complicated and can be difficult to adjust the position of the lamp in some situations. Therefore, there is a continuing need in the industry for improved adjustment mechanisms for lamp assemblies.

SUMMARY OF THE INVENTION

The present invention is directed to an adjustable lighting fixture that can be used for ceiling-mounted assemblies or recessed lighting assemblies. The invention is particularly directed to an adjustable lighting assembly where the lamp can be adjusted to direct the light to the target area.

The adjustable light assembly of the invention includes a lamp holder and lamp which can be rotated about a vertical axis and adjusted about a horizontal axis independent of the adjustment about the vertical axis. The adjustable light assembly of the invention can include a single lamp holder and lamp or a plurality of lamp holders and lamps where each lamp can be adjusted independently of the other.

One aspect of the invention is to provide an adjustable light assembly that is easy to construct and assemble by the technician. In one embodiment of the invention, the adjustment mechanism for the light assembly can be accessed through the open bottom of the assembly. In this manner, the lamp can be adjusted easily by rotating about a vertical axis and adjusting about a horizontal axis after the light assembly is installed and mounted in a ceiling.

Another aspect of the invention is to provide an adjustable lighting assembly having a locking member that is able to fix the angular position of the lamp and lamp holder about a vertical axis and about a horizontal axis. In one embodiment of the invention, the locking member simultaneously locks the position of the adjustable light assembly to prevent rotation about the vertical axis and to prevent rotation about the horizontal axis.

The various aspects of the invention are obtained by providing an adjustable light assembly comprising a base, a bracket, a lamp support and an adjustment assembly. The base has a central opening with a top surface and a bottom surface. The bracket is positioned above the top surface of the base. The lamp support is pivotally coupled to the bracket for adjusting the angular position of the lamp support with respect to the bracket and the base. An adjustment assembly is included on the bracket for adjusting the angular position of the lamp support with respect to the bracket.

The aspects of the invention are also obtained by providing an adjustable lighting assembly comprising a base having a central opening and a frame with an upper end spaced from a top surface of the base, a bracket coupled to the upper end of the frame and a lamp support coupled to the bracket. The bracket is pivotable about a first axis substantially perpendicular to the plane of the base and parallel to a central axis of the opening in the base. The lamp support is pivotally coupled to the bracket and is pivotable about a second axis substantially perpendicular to the first axis.

The aspects of the invention are also obtained by providing an adjustable lighting assembly comprising a base, a frame coupled to the base, a bracket, a lamp support, an adjustment mechanism and a locking mechanism. The base has a bottom surface and a top surface. The frame is coupled to the base and has an upper plate spaced from the top surface of the base. The bracket is coupled to the upper plate of the frame and is pivotable about an axis substantially perpendicular to a plane of the base. The lamp support is pivotally coupled to the bracket and is pivotable about a second axis substantially perpendicular to the first axis. The adjustment mechanism is coupled to the bracket for adjusting the position of the lamp support with respect to the bracket. The locking mechanism fixes the position of the lamp support to the bracket and fixes the position of the bracket with respect to the frame.

These and other aspects of the invention will become apparent from the following detailed description of the invention and the annexed drawings which disclose various embodiments of the invention.

BRIEF DESCRIPTION OF THE DRAWINGS

The following is a brief description of the drawings in which.

DETAILED DESCRIPTION OF THE INVENTION

Figure 1:
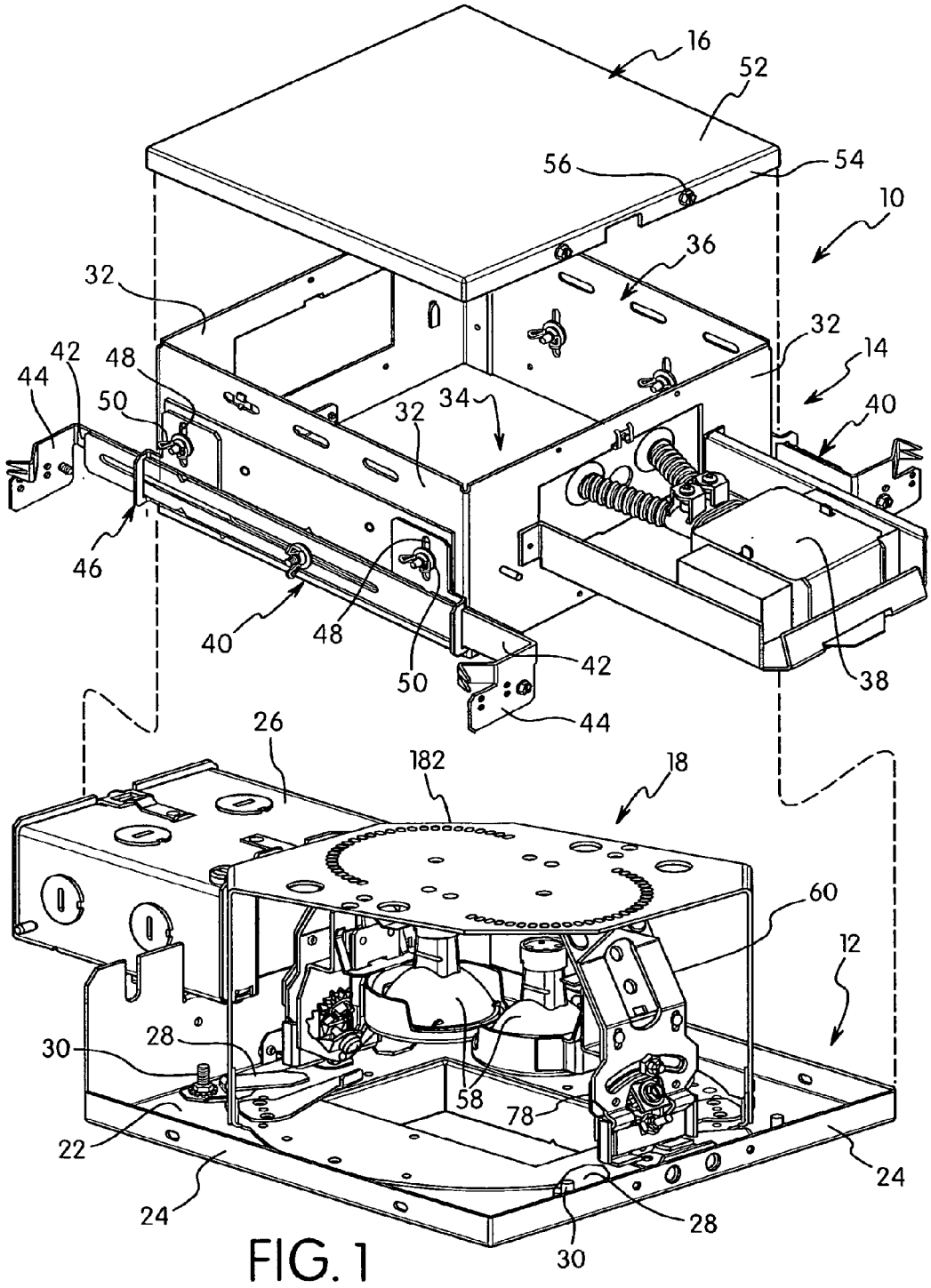
FIG. 1 is an exploded perspective view of one embodiment of the adjustable lamp assembly of the invention.

The present invention is directed to a luminaire assembly having a lamp aiming device. The invention is particularly directed to a luminaire and light assembly where the angle and the position of the lamp and lamp support can be adjusted to direct the light to a target site.

Referring to the drawings, the luminaire and light assembly 10 of the invention includes a ceiling pan 12 having a housing 14 with a cover 16 closing the top end of the housing 14. Positioned within the housing 14 is light assembly 18 having a lamp support and aiming assembly.

Referring to FIG. 1, ceiling pan 12 is constructed for mounted in a ceiling in a conventional manner. Ceiling pan 12 has a flat bottom wall 22 with an upwardly extending peripheral flange 24. An electrical box 26 is mounted to flange 24 for enclosing electrical wiring components for the assembly in a conventional manner. Bottom wall 22 has a central opening (not shown) below light assembly 18 for directing light to the target site. Hold down brackets 28 are provided for coupling light assembly 18 to ceiling pan 12. In the embodiment illustrated, hold down brackets 28 are attached to bottom wall 20 by screws 30 or other fasteners. Hold down brackets 28 have a substantially L shape and overlie the top surface of light assembly 18 to allow axial rotation and limited lateral movement of light assembly 18 with respect to ceiling pan 12. In use, a trim ring and diffuser (not shown) are attached to the bottom side of light assembly 10.

Housing 14 has a side wall 32 with an open bottom 34 and an open top 36. Side walls 32 of housing 14 are coupled to flange 24 of ceiling pan 12 by screws or other fasteners. An electrical box 38 is coupled to side wall 32 containing electrical components for light assembly 18.

Adjustable mounting hanger bars 40 are attached to opposite side walls 32 of housing 14. Mounting bars 40 include extending bars 42 having mounting tabs 44 for mounting to ceiling joists or other support structure. Mounting bars 42 are mounted to a mounting bracket 46 for sliding movement. Mounting bracket 46 includes slots 48 for receiving adjusting screws 50. Slots 48 allow vertical adjustment of mounting bars 40 with respect to housing 14 so that housing 14 and ceiling pan 12 can be vertically adjusted after mounting bars 40 are attached to a ceiling joist or other support. Adjusting screws 50 are tightened to fix the position of housing 14 with respect to hanger bar 42.

Cover 16 includes top wall 52 having a downwardly extending flange 54. Flange 54 is coupled to side wall 32 of housing 14 by screws 56 to enclose light assembly 18.

Figure 2:
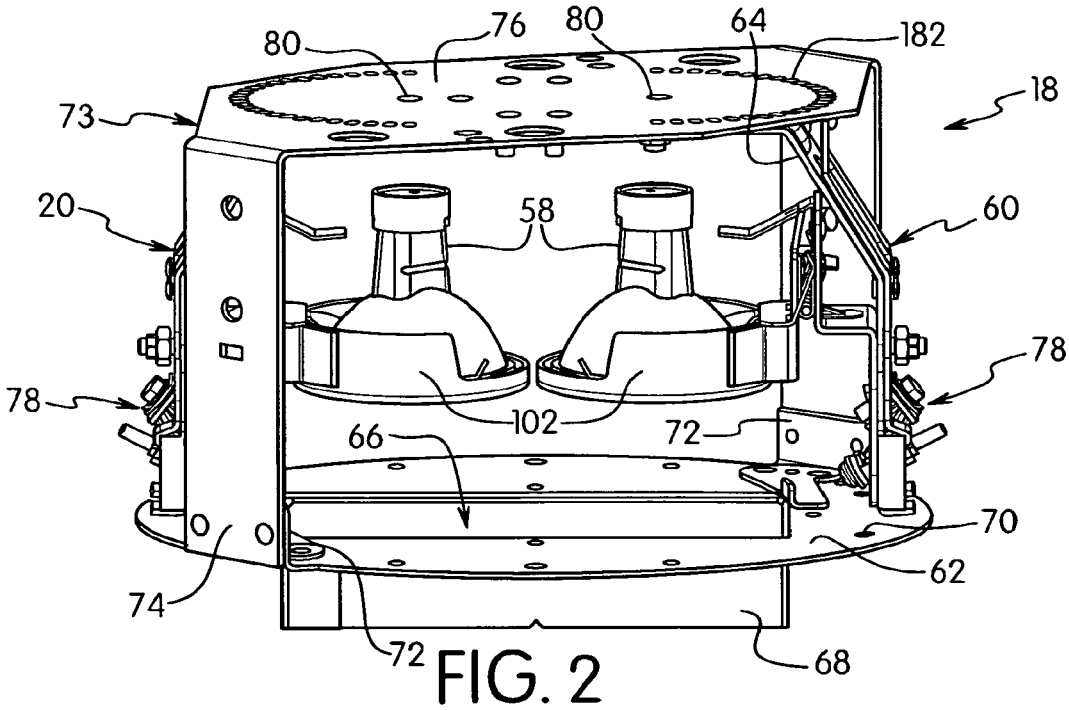
FIG. 2 is a perspective view of the adjustable lighting assembly without the plaster frame and the housing enclosing the lamp assembly.
Figure 3:
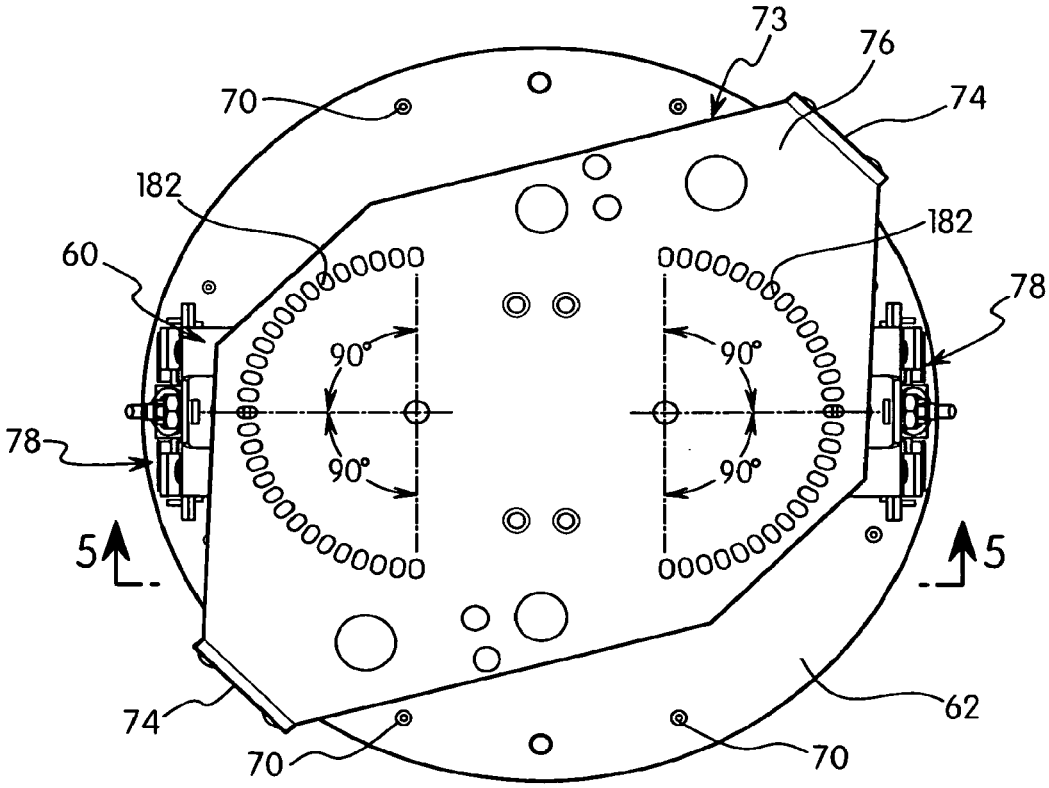
FIG. 3 is a top view of the lighting assembly of FIG. 2.
Figure 4:
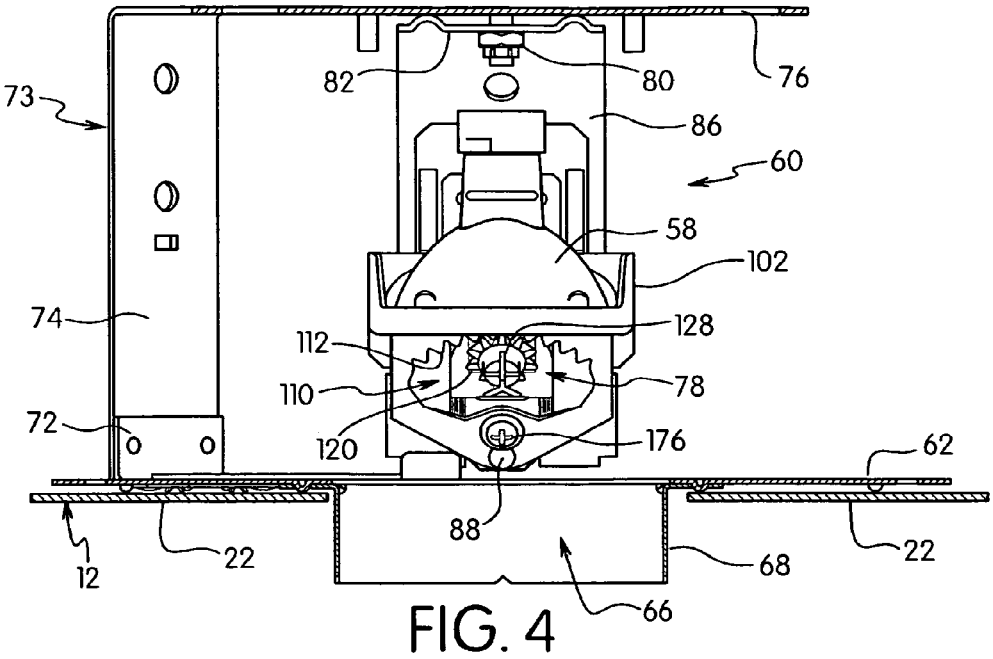
FIG. 4 is an end view of the lighting assembly of FIG. 4.

In the embodiment of FIGS. 1-14, light assembly 18 includes two lamps 58 with each mounted to a respective lamp support 60. Each lamp 58 and lamp support 60 are independently adjustable with respect to the other to direct light to different areas or focus the light to a common or overlapping area. Referring to FIGS. 2 and 3, light assembly 18 includes a base 62 and a bracket 64. Base 62 in the embodiment illustrated has a substantially flat circular shape with a dimension to fit within flanges 24 of ceiling pan 12. Base 62 has a central opening 66 and a sleeve 68 extending downwardly from a bottom side of base 62. Sleeve 68 extends from the peripheral edge of central opening 66 for directing light from lamps 58 to the target area. In the embodiment shown, sleeve 68 extends through the opening in bottom wall 24 of ceiling pan 12.

In the embodiment of FIG. 2, sleeve 68 has a substantially rectangular configuration corresponding to the two lamp supports 60 and respective lamps 58. In other embodiments, sleeve 68 can have any shape and dimension corresponding to the desired lighting pattern. Sleeve 68 extends through the opening in ceiling pan 12 and has a dimension to allow rotational and lateral movement of light assembly 18 with respect to ceiling pan 12. Base 62 typically includes a plurality of spaced apart embossed dimples 70 extending downwardly to provide a glide surface for light assembly 18 on the bottom wall 22 of ceiling pan 12.

A frame 73 is coupled to base 62 by screws or rivets. As shown in FIG. 2, base 62 includes upwardly extending flanges 72 for coupling to frame 73. Frame 73 includes two upwardly extending arms 74 and a top wall 76 extending between arms 74 to form a yoke. Arms 74 are coupled to flanges 72 and extend upwardly from base 62. Top wall 76 has a substantially planar shape and is oriented substantially parallel to base 62. Top wall 76 of frame 73 is spaced from base 62 a distance to support the lamp 58 and lamp support 60.

Figure 5:
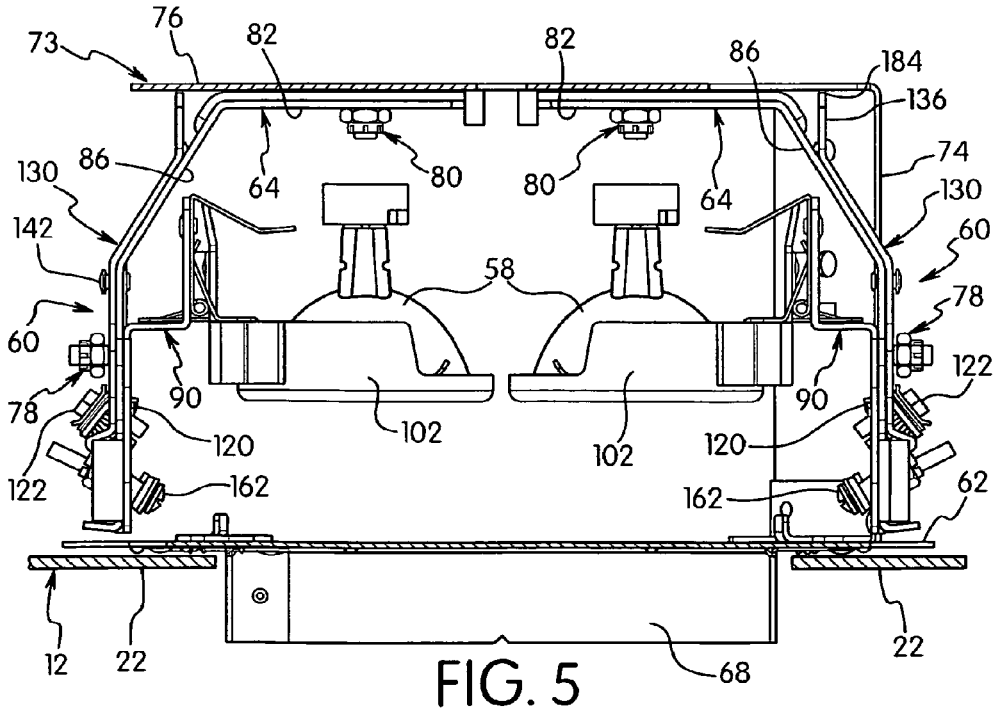
FIG. 5 is a cross-sectional view of the lighting assembly taken along line 5-5 of FIG. 3.

Lamp support 60 of light assembly 18 includes an adjustment assembly 78 for adjusting the angular position of lamp support 60 and the corresponding lamp 58 as shown in FIGS. 2-7. Bracket 64 in preferred embodiments is pivotally coupled to frame 73 as shown in FIG. 5. Preferably, bracket 64 is coupled to top wall 76 of frame 73 by a nut and bolt assembly 80 to enable bracket 64 to pivot about a vertical axis substantially perpendicular to the plane of base 62. The vertical axis is defined by the normal orientation of the assembly. Bracket 64 has a top leg 82 having an aperture for receiving the bolt 80 and lies substantially parallel to a bottom surface of top wall 76 of frame 73. Bracket 64 includes a bottom leg 84 which extends in a vertical direction perpendicular to the plane of base 62 and is substantially perpendicular to the plane of top leg 82. In the embodiment illustrated, top leg 82 and bottom leg 84 are connected by an intermediate inclined portion 86. Bottom leg 84 has a bottom end that is spaced above the top surface of base 62 so that bracket 64 is supported by frame 73 above base 62.

Figure 10:
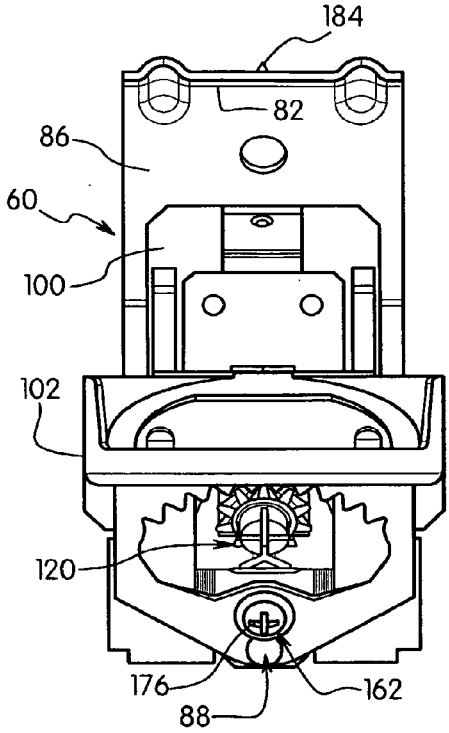
FIG. 10 is an end view of the adjustment assembly of FIG. 9.
Figure 11:
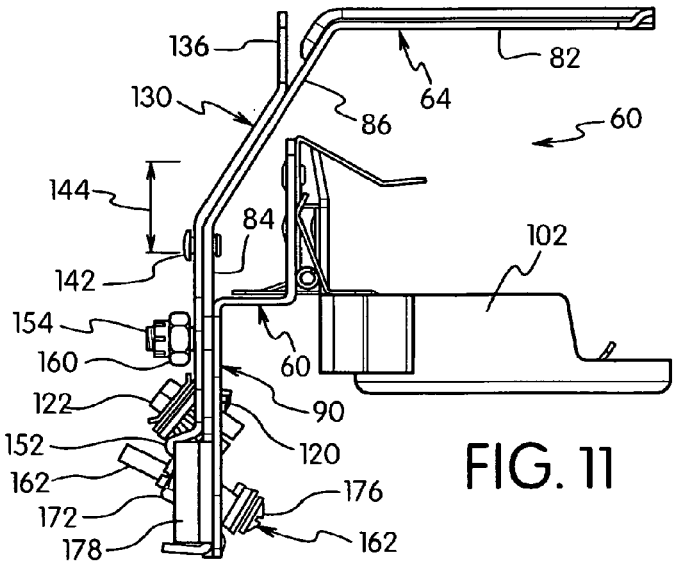
FIG. 11 is a side view of the adjustment assembly of FIG. 9.

Referring to FIGS. 10 and 11, a lamp support bracket 90 is coupled to bracket 64 by a pivot pin 88. Pivot pin 88 is typically a rivet or screw that extends through aligned holes in lamp support bracket 90 and bracket 64 to enable pivotable movement between the components.

Lamp support bracket 90 pivots with respect to bracket 64 about an axis substantially perpendicular to the axis of rotation of bracket 64 with respect to frame 73. In preferred embodiments, lamp support bracket 90 pivots about a horizontal axis with respect to a longitudinal dimension of bracket 64 and the plane of base 62. Lamp support bracket 90 pivots to allow angular adjustment of the respected lamp 58 to direct light through central opening 66 and collar 68 in the desired direction.

Figure 12:
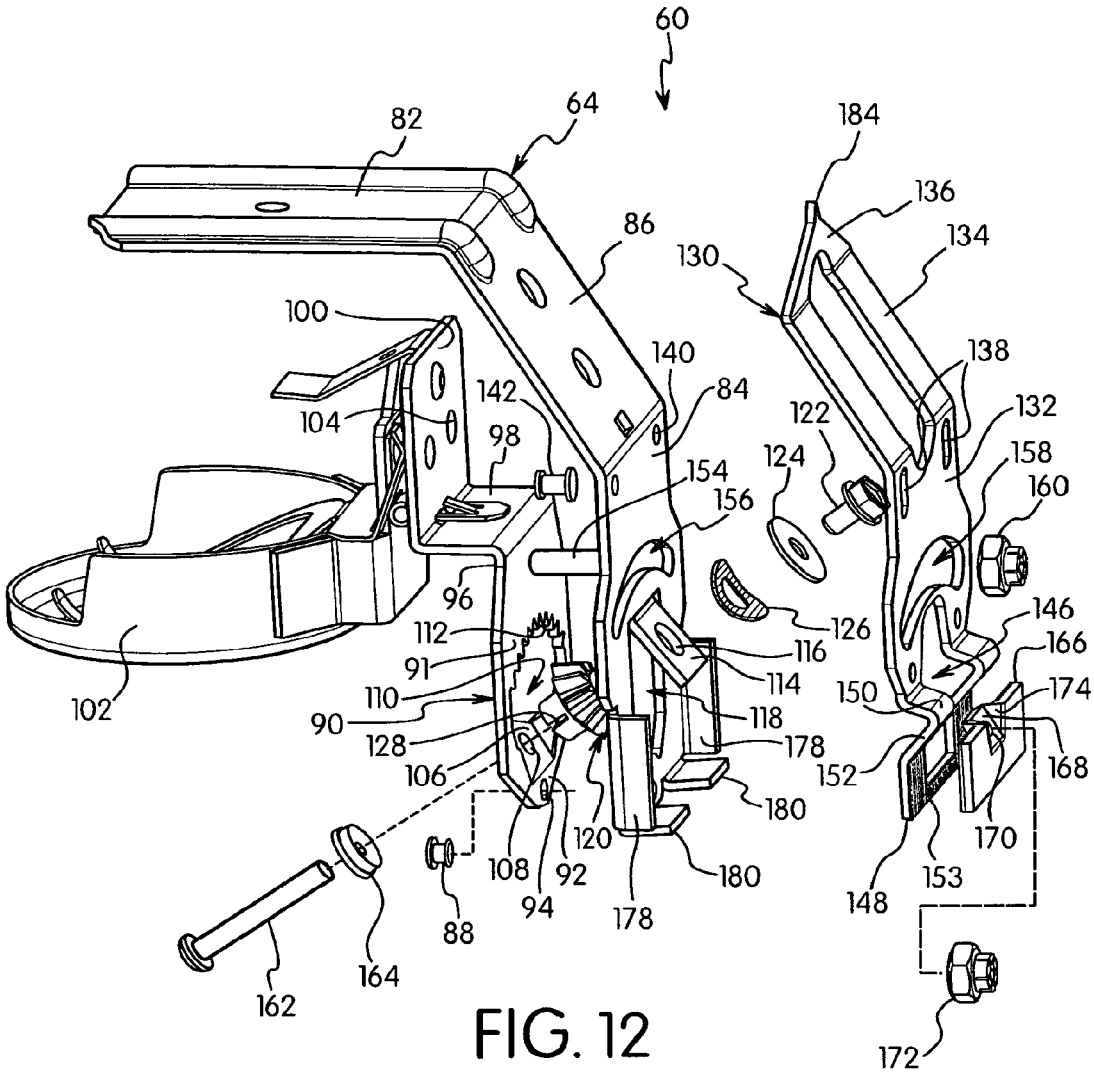
FIG. 12 is an exploded perspective view of the front side of the adjustment assembly of FIG. 9.
Figure 13:
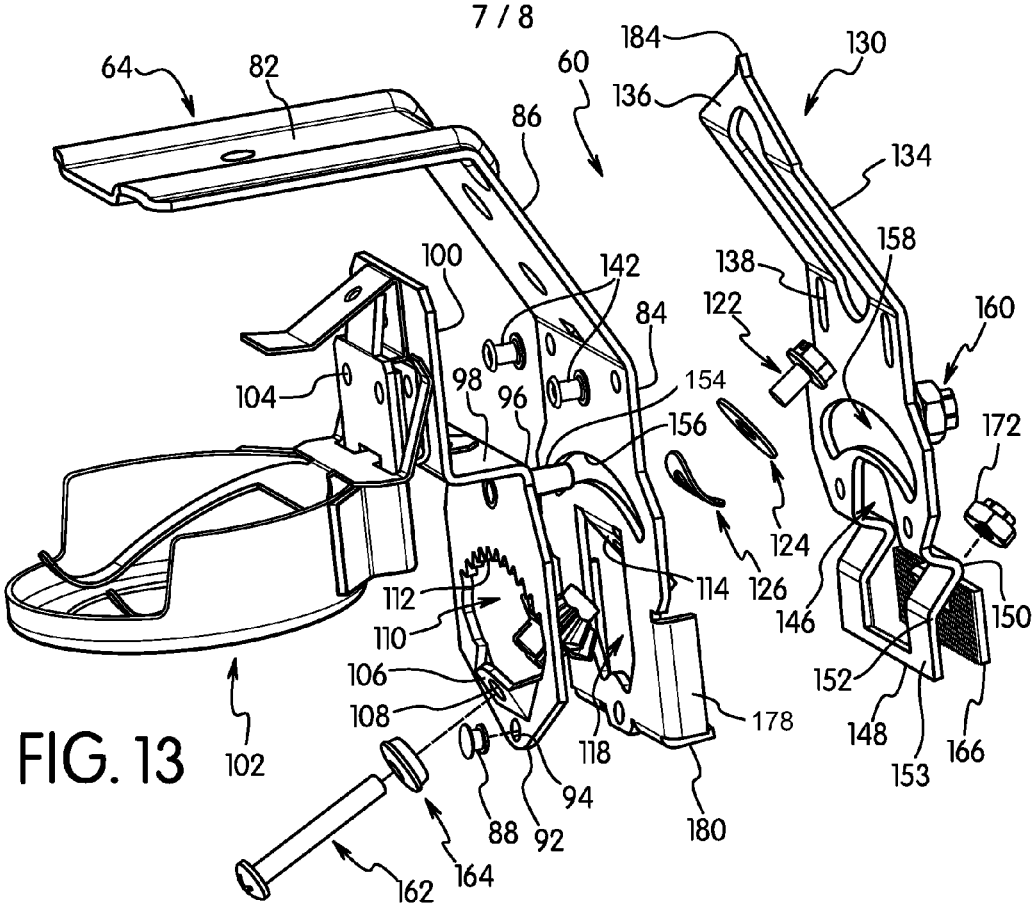
FIG. 13 is a perspective view of the rear side of the adjustment assembly of FIG. 9.

Lamp support bracket 90 as shown in FIG. 12 includes a body 91 having a bottom end 92 with a pivot hole 94 for receiving pivot pin 88. Body 91 has a top end 96 forming an outwardly extending leg 98 and an upwardly extending leg 100. A lamp holder 102 is coupled to upper leg 100 for supporting the lamp 58 as shown in FIG. 5. Preferably, lamp holder 102 is coupled to upper leg 100 by rivets or other suitable fasteners 104.

Body 91 of lamp support bracket 90 includes an outwardly extending angled flange 106 having an aperture 108 and an open area 110. Flange 106 is formed at an incline with respect to the plane of body 91. A central opening 110 has a curved top edge with a plurality of teeth 112. Bracket 64 includes an angled flange 114 with an aperture 116 extending away from an open area 118. Angled flange 114 of bracket 64 is aligned with the open area 110 of lamp support bracket 90.

A beveled gear 120 is rotatably coupled to flange 114 of bracket 64 by a fastener such as a bolt 122. Bolt 122 extends through a washer 124 and a spring washer 126. Bolt 122 is threaded into a threaded hole in the axial end of beveled gear 120 to rotatably mount beveled gear 120 to bracket 64. Beveled gear 120 has a slotted end 128 for receiving a screw driver or other tool for manually rotating beveled gear 120. As shown in FIG. 10, beveled gear 120 meshes with teeth 112 in opening 110 of lamp support bracket 90. Rotating beveled gear 120 causes lamp support bracket 90 to pivot about pivot pin 88 with respect to bracket 64. The width of opening 110 which receives beveled gear 120 defines the limits of the angular adjustment of lamp support bracket 90 with respect to bracket 64 and base 62 of light assembly 18.

Lamp support 60 further includes a locking member 130 coupled to bracket 64. Locking member 130 has a body 132, an angled portion 134 and an upwardly extending tab 136 corresponding substantially to the shape of bracket 64. Body 132 and angled portion 134 overlie bottom leg 84 and angled portion 86 respectively of bracket 64 as shown in FIG. 11. Tab 136 extends in an upward direction substantially parallel to body 132.

Referring to FIG. 12, body 132 of locking member 30 has two spaced apart elongated slots 138 that are aligned with holes 140 in bracket 64 which receive rivets 142 or other fasteners. Rivets 142 extend through holes 140 and slots 138 to allow limited linear movement of locking member 130 with respect to bracket 64. As shown in FIG. 11, locking member 130 slides in an up and down direction as indicated by arrow 144 with respect to bracket 60. Rivets 142 preferably have enlarged heads to couple locking member to bracket 64 as shown in FIG. 5.

Body 132 of locking member 130 has an open portion 146 adjacent the bottom end 148. Body 132 is formed with a bend 150 extending outwardly and forming an inclined cam surface 152. A flat bottom portion 153 extends from cam surface 152 and lies in the plane of body 32.

Body 91 of lamp support bracket 90 includes a threaded screw 154 extending outwardly perpendicular to the plane of body 91. Screw 154 extends through a curved arcuate shaped slot 156 in bracket 64 and a curved arcuate slot 158 in locking member 130. A threaded nut 160 is coupled to the end of screw 154 as shown in FIG. 11. Curved slots 156 and 158 overlie each other and have substantially the same length. Slots 156 and 158 limit pivotal movement of lamp support bracket 90 with respect to bracket 64 and locking member 130. In the embodiment illustrated, curved slot 156 of bracket 64 has a width corresponding substantially to the outer dimension of screw 154 so that slot 156 can slide easily on screw 154. Curved slot 158 of locking member 130 has a width greater than the diameter of screw 154 to allow limited linear movement of locking member 130 in the up and down direction of arrow 144 as shown in FIG. 11.

A locking screw 162 extends through a washer 164 and through the aperture 108 in the angled flange 106 of lamp support bracket 90. A clamping member 166 is coupled to locking screw 162. Clamping member 166 includes an inclined flange 168 with a hole 170 aligned with aperture 108 in angled flange 106 of lamp support bracket 90. Locking screw 162 extends through hole 170 in flange 168 of clamping member 166 and is coupled thereto by a nut 172. Angled flange 168 is formed with side edges 174 of clamping member 166 with a dimension corresponding substantially to the outer dimension of nut 172. Side portions 174 are spaced apart a distance to substantially prevent rotation of nut 172 whereby rotation of screw 162 draws nut 172 and clamping member toward lamp support bracket 90. Locking screw 162 extends through hole 170 of flange 168 and is threaded into nut 172 to couple clamping member 166 to the assembly. As shown in FIG. 10, locking screw 162 has a slot 176 for receiving a screw driver or other tool.

Clamping member 166 has a substantially rectangular configuration and contacts the bottom end of locking member 130 as shown in FIG. 12. Locking screw 162 can be rotated to apply a clamping force between clamping member 166 and locking member 130. The upper edges of clamping member 166 engage the inclined cam surface 152 of locking member when locking screw is tightened which causes locking member 130 to slide in an upward direction. Locking member 130 slides downwardly by gravity to the position shown in FIG. 6 when locking screw 162 is loosened from nut 172. Locking screw 162 can be tightened to clamp lamp support 60 to bracket 64 to prevent angular rotation of lamp support 60 with respect to bracket 64. In one embodiment of the invention, bracket 64 includes side tabs 178 and bottom tabs 180 which serve as a guide for locking member 130 and clamping member 166 with respect to bracket 64.

Figure 6:
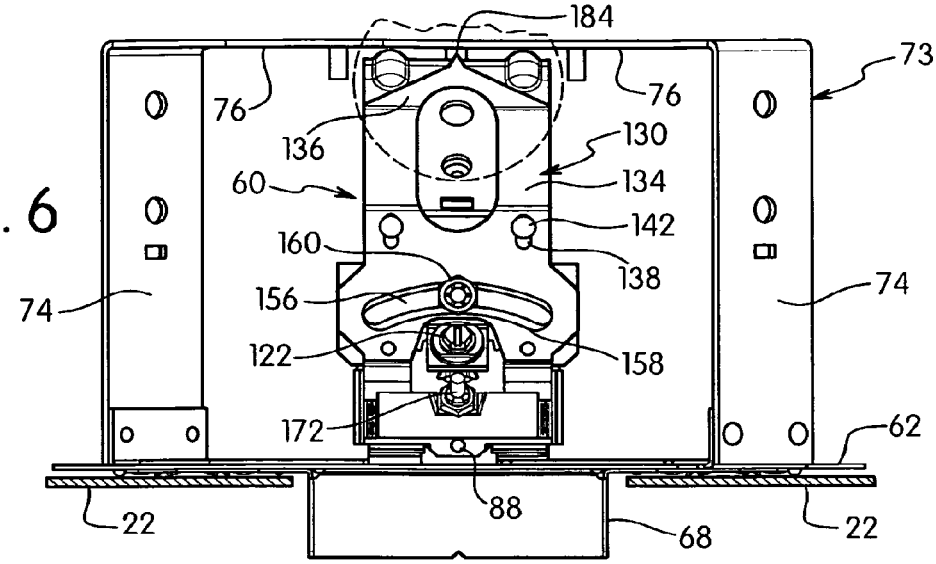
FIG. 6 is an end view of the lighting assembly of FIG. 2 showing the locking member in the unlocked position.
Figure 7:
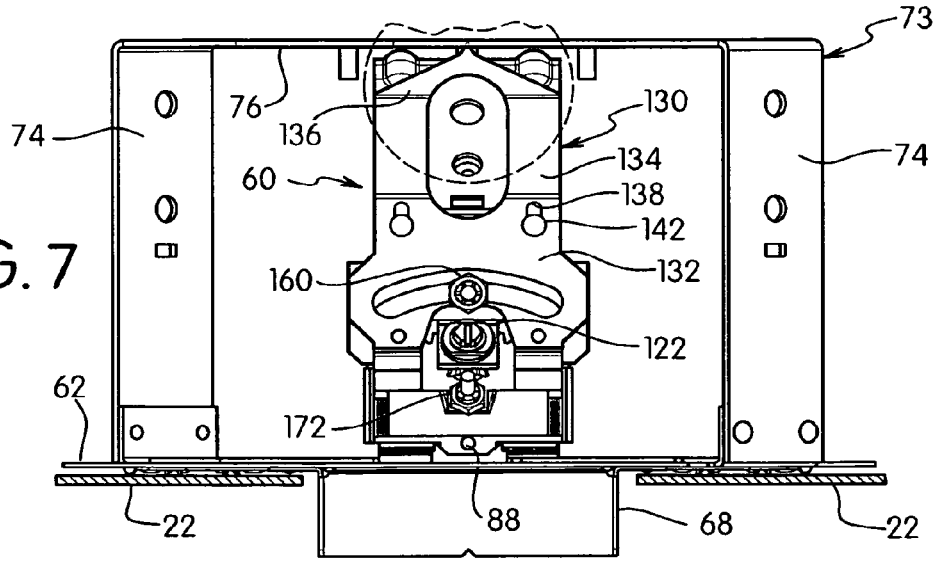
FIG. 7 is an end view showing the locking member in the locked position.
Figure 8:
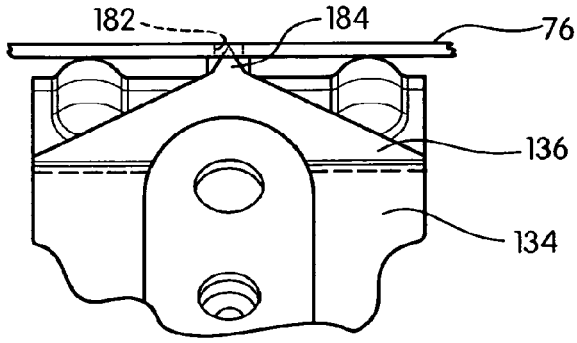
FIG. 8 is an enlarged partial end view showing the locking member engaging the frame of the lighting assembly.
Figure 9:
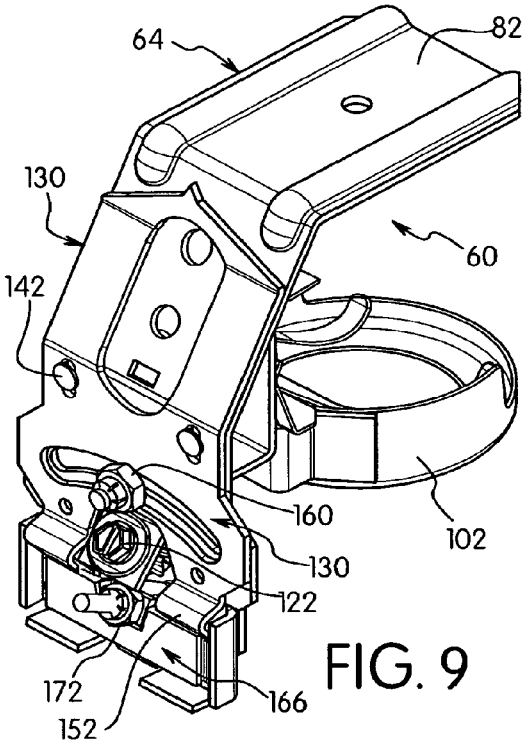
FIG. 9 is a perspective view of the adjustment assembly of the lighting assembly.

Referring to FIGS. 2 and 3, top wall 76 of frame 73 includes a plurality of holes 182 arranged in an arcuate path around the pivot point of bracket 64 defined by the nut and bolt 80. As shown in FIG. 3, frame 72 is provided with a plurality of holes 182 arranged in a semi-circular pattern which allow bracket 64 to pivot about 180°. Locking member 130 includes a point 184 extending upwardly from upper tab 136 for selectively engaging one of the holes 182 to lock bracket 64 with respect to frame 73 and prevent rotation about the vertical axis. As shown in FIG. 6, locking screw 162 is in a retracted position to release the tension on clamping member 166 which allows locking member 130 to slide downwardly. When locking member 130 is in the position shown in FIG. 6, bracket 64 can be pivoted about the vertical axis with respect to frame 73. When the angular position of bracket 164 is selected and the angular position of lamp support 60 is selected, locking screw 162 is tightened. Tightening locking screw 162 forces the top edge of clamping member 166 into engagement with the inclined cam surface 152 of locking member which urges locking member 130 in an upward direction to the position shown in FIG. 7. In the position shown in FIG. 7, point 164 is received in one of the holes 182 to prevent rotational movement of bracket 64 about the vertical axis with respect to frame 73. Simultaneously, the clamping force of locking screw prevents rotation of lamp support bracket 90 about the horizontal axis with respect to bracket 64.

Figure 14:
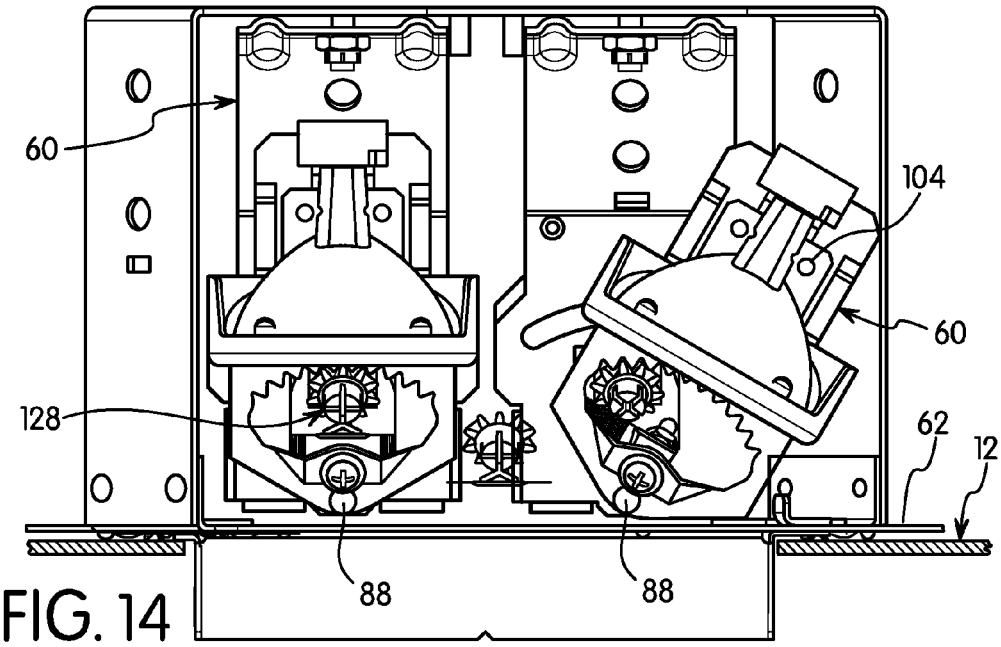
FIG. 14 is a side view of the lamp assembly showing the two lamps adjusted in different positions.

Light assembly 18 is constructed so that beveled gear 120 and locking screw 162 are accessible through the open end of base 62. During use, the assembly is mounted to a ceiling by the mounting bars. The technician is able to adjust the position of each light assembly 18 through central opening 166 in base 62 by rotating bracket 64 manually to the desired position. As shown in FIG. 14, each of the light assemblies 18 are independently adjustable with respect to each other. A screw driver or other tool can then be inserted through central opening 166 of base 62 to engage beveled gear 120. Rotating beveled gear 120 adjusts the angular position of lamp support bracket 90 with respect to bracket 64. After lamp support bracket 90 is adjusted to the desired position, locking screw 162 is tightened using a suitable tool. Rotating locking screw 162 clamps lamp support bracket 90 with respect to bracket 64 and pushes locking member 130 upwardly into engagement with frame 73 to lock and prevent rotational movement of bracket 64 with respect to frame 73.

Figure 15:
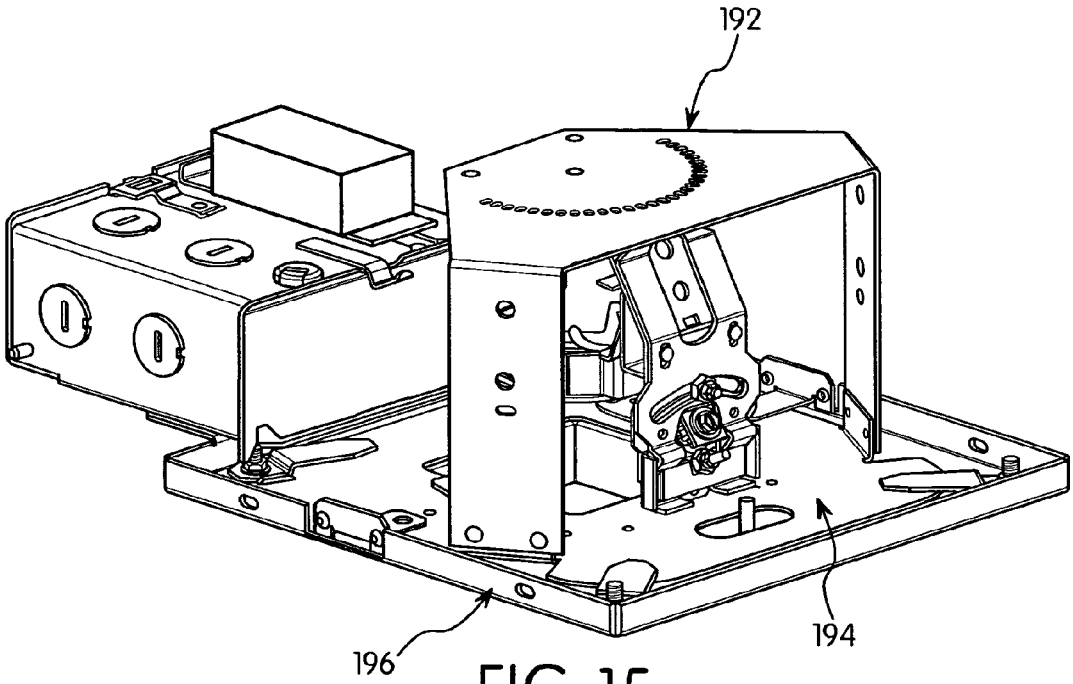
FIG. 15 is a perspective view of an alternative embodiment of the lighting assembly.
Figure 16:
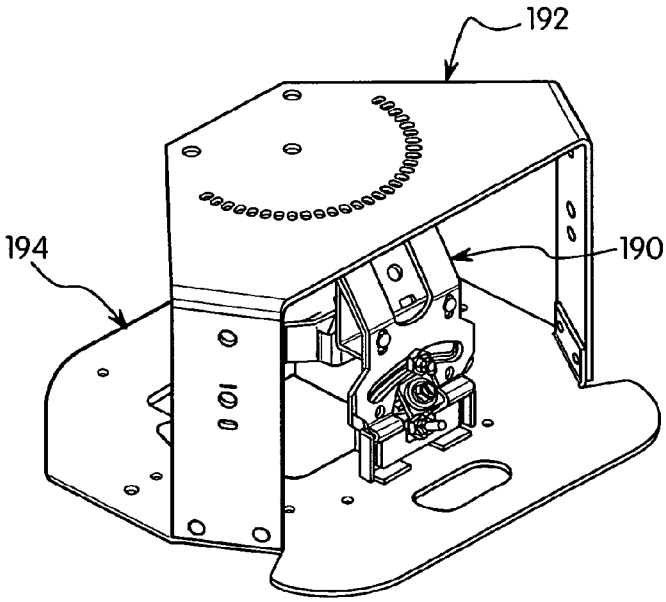
FIG. 16 is a perspective view showing the adjustment assembly of the embodiment of FIG. 15.

In the embodiment of FIGS. 1-14, assembly 10 is provided with two light assemblies coupled to the frame 73. Each lighting assembly is independently adjustable by rotation around the vertical axis and adjustable by rotating about the horizontal axis of the aiming assembly. In another embodiment shown in FIGS. 15 and 16, a single aiming assembly 190 is pivotally connected to a frame 192 coupled to a base 194. Base 194 is mounted to the ceiling pan 196. Frame 192 is constructed in a similar manner to the previous embodiment with the exception of supporting a single light assembly 190 and having a single array of apertures 198 arranged around the pivot point 200 which supports the light assembly as in the previous embodiment. Light assembly 190 is substantially the same as aiming assembly 20 of the previous embodiment so that identical components are identified by the same reference number.

While various embodiments have been described and shown in the drawings, it will be understood by one skilled in the art that various changes and modifications can be made without departing from the scope of the invention as defined in the appended claims.

What is claimed is:

1. An adjustable light assembly comprising:

a base having a central opening, a top surface, and a bottom surface;

a bracket positioned above said top surface of said base, said bracket being rotatable about a vertical axis with respect to said base;

a lamp support pivotally coupled to said bracket for adjusting the angular position of said lamp support with respect to said bracket and base; and an adjustment assembly for adjusting the angular position of said lamp support.

2. The light assembly of claim 1, further comprising;

a frame coupled to said base and extending in an upward direction with respect to said top surface of said base, and said bracket being coupled to said frame and pivotable about a vertical axis with respect to said base.

3. The light assembly of claim 2, wherein said adjustment assembly comprises;

a gear pivotally connected to said bracket, and where said lamp support includes a plurality of teeth meshing with said gear so that rotation of said gear pivots said lamp support with respect to said bracket.

4. The light assembly of claim 2, wherein said adjustment assembly comprises;

a locking member to fix the position of said bracket with respect to said frame.

5. The light assembly of claim 4, wherein said locking member of said adjustment assembly fixes the position of said lamp support to said bracket.

6. The light assembly of claim 5, further comprising;

a locking screw coupled to said bracket, and where said locking screw moves said locking bracket into engagement with said frame to prevent rotation of said bracket with respect to said frame.

7. The light assembly of claim 6, wherein
said frame includes at least one aperture for receiving said locking member to lock the position of said bracket.

8. The light assembly of claim 6, wherein
said locking screw is received in a threaded aperture of said bracket, wherein tightening said locking screw actuates said locking member into locking engagement with said frame and locks the position of said lamp support to said bracket.

9. The light assembly of claim 8, wherein
said locking member includes a cam follower and where said locking screw actuates a cam to move said locking member into engagement with said frame.

10. An adjustable light assembly comprising:
a base having a central opening and a frame with an upper end spaced from a top surface of said base;
a bracket coupled to said upper end of said frame and being pivotable about a first axis substantially perpendicular to a plane of said base and substantially parallel to a central axis of said opening in said base, said bracket having an arm extending toward said base; and
a lamp support coupled to said arm of said bracket and being pivotable about a second axis substantially perpendicular to said first axis.

11. The light assembly of claim 10, wherein
said lamp support is coupled to said bracket by a pivot member to pivot in a plane parallel to a plane of said arm of said bracket, said light assembly further including an adjustment mechanism.

12. The light assembly of claim 11, wherein
said adjustment mechanism includes a rotatable gear on one of the bracket arms or lamp support and a plurality of teeth engaging the gear on the other of the bracket arm or lamp support, whereby rotation of the gear pivots said lamp support with respect to said arm.

13. The light assembly of claim 11, wherein
said adjustment mechanism includes a gear rotatably mounted on said arm of said bracket, and where said lamp support includes an elongated slot with inwardly extending gear teeth, said gear being received within said slot and mating with said gear teeth, whereby rotation of said gear pivots said lamp support to a selected position.

14. The light assembly of claim 10, further comprising;
a locking assembly to fix the position of said bracket with respect to said frame and to fix the position of said lamp support with respect to said bracket.

15. The light assembly of claim 14, wherein
said locking assembly includes a locking member coupled to said bracket and is movable to engage said frame to fix the position of said bracket with respect to said frame.

16. The light assembly of claim 15, further comprising;
an actuator to engage and move said locking member into locking engagement with said frame.

17. The light assembly of claim 15, further comprising;
a screw received in a hole in said bracket and extending through a hole in said lamp support, wherein said screw is tightened to fix the position of said lamp support with respect to said bracket and to move said locking member into engagement with said frame.

18. The light assembly of claim 17, further comprising;
a cam member with a threaded hole receiving said screw, said locking member having a cam follower engaging said cam, whereby tightening said screw moves said cam to move said locking member into engagement with said frame.

19. The light assembly of claim 15, wherein
said frame includes at least one aperture for receiving an end of said locking member to fix the position of said bracket to said frame.

20. The light assembly of claim 15, wherein
said frame includes a plurality of holes defining predetermined positions of said bracket, and where said locking member includes a tip at an upper end thereof for engaging one of said holes to fix the position of said bracket to said frame.

21. An adjustable lighting assembly comprising:
a base having a bottom surface and a top surface;
a frame coupled to said base and having an upper plate spaced from said top surface of said base;
a bracket coupled to said upper plate of said frame and being pivotable about a first axis substantially perpendicular to a plane of said base;
a lamp support pivotably coupled to said bracket and being pivotable about a second axis substantially perpendicular to said first axis;
an adjustment mechanism coupled to said bracket for adjusting the position of said lamp support with respect to said bracket; and
a locking mechanism for fixing the position of said lamp support to said bracket and for fixing the position of said bracket with respect to said frame.

22. The lighting assembly of claim 21, wherein said adjustment mechanism includes;
a gear rotatably coupled to said bracket, and where said lamp support includes a plurality of teeth engaging said gear, whereby rotation of said gear pivots said lamp support with respect to said bracket in a plane substantially parallel to a plane of said bracket.

23. The lighting assembly of claim 22, wherein said locking mechanism comprises;
a locking member coupled to said bracket for engaging said frame to fix the position of said bracket with respect to said frame.

24. The lighting assembly of claim 23, further comprising;
a locking screw extending through said lamp support and bracket for locking the position of said lamp support with respect to said bracket.

25. The lighting assembly of claim 24, wherein
said locking screw is coupled to a cam member which engages a cam follower on said locking member to move said locking member into engagement with said frame.

26. The lighting assembly of claim 25, wherein
said frame includes a plurality of holes, and where said locking member includes a top end received in one of said holes to fix the position of said bracket to said frame.

27. An adjustable light assembly comprising:
a base lying in a plane and having a support frame fixed to said base, said support frame having an upper end spaced from a top surface of said base;
a first bracket pivotally coupled to said upper end of said frame and being pivotable with respect to said base and support frame about a first axis substantially perpendicular to the plane of said base;
a first lamp support coupled to said first bracket, said lamp support and first bracket being pivotable about said first axis with respect to said base.

28. The adjustable light assembly of claim 27, wherein
said base includes an opening and said first axis is aligned with said opening.

29. The adjustable light assembly of claim 27, wherein said first lamp support is pivotable with respect to said first bracket about an axis that is different from said first axis to adjust the angular position of said lamp support with respect to said base.

30. An adjustable light assembly comprising:

a base having a support frame with an upper end spaced from a top surface of said base;

a first bracket coupled to said upper end of said frame and being pivotable with respect to said base about a first axis substantially perpendicular to a plane of said base;

a first lamp support coupled to said bracket, said lamp support and bracket being pivotable about said first axis with respect to said base;

a second bracket coupled to said frame and being pivotable with respect to said base about a second axis; and a second lamp support coupled to said second bracket, said first lamp support and said second lamp support being independently adjustable with respect to said base.

31. The adjustable light assembly of claim 30, wherein said first lamp support is adjustable to adjust the angular position of said first lamp support with respect to said first bracket; and said second lamp support is adjustable to adjust the angular position of said second lamp support with respect to said second bracket.

32. The adjustable light assembly of claim 31, wherein said first lamp support includes a first adjustment assembly for adjusting the angular position of said first lamp support; and said second lamp support includes a second adjustment assembly for adjusting the angular position of said second lamp.

* * * * *